US006047641A

United States Patent [19]

Chagnon

[11] Patent Number: 6,047,641

[45] Date of Patent: Apr. 11, 2000

[54] APPARATUS FOR HOLDING A PRINTING PLATE INCLUDING A TENSION ROD AND PISTON ROD

[75] Inventor: Franck Chagnon, S'Lev D'esserent, France

[73] Assignee: Heidelberger Druckmaschinen Aktiengesellschaft, Heidelberg, Germany

[21] Appl. No.: 09/283,070

[22] Filed: Mar. 31, 1999

[30] Foreign Application Priority Data

Mar. 31, 1998 [FR] France ..... 98 03980

[51] Int. Cl.[7] ..... B41F 27/12

[52] U.S. Cl. ..... 101/415.1; 101/378

[58] Field of Search ..... 101/415.1, 378

[56] References Cited

U.S. PATENT DOCUMENTS 5,555,807 9/1996 Pollet ..... 101/415.1

5,596,928 1/1997 Marmin et al. ..... 101/415.1

5,598,780 2/1997 Marmin et al. ..... 101/415.1

*Primary Examiner*—John S. Hilten

*Assistant Examiner*—Leslie J. Grohusky

*Attorney, Agent, or Firm*—Herbert L. Lerner; Laurence A. Greenberg; Werner H. Stemer

[57] ABSTRACT

A retainer for firmly holding a printing plate on a plate-carrying cylinder by a hook that engages in an elongated gap formed in the cylinder and is fixedly connected to a tension rod guidable rotatably by drive mechanisms so that it is alignable relatively to two limiting directions in accordance with two limit positions. The drive mechanisms include a piston rod that is supported in a longitudinal bore formed in the cylinder, the piston rod carrying a plurality of pistons distributed over the entire length thereof and including a longitudinal conduit selectively suited for supplying pressure medium for positioning the pistons selectively in two extreme positions.

11 Claims, 11 Drawing Sheets

APPARATUS FOR HOLDING A PRINTING PLATE INCLUDING A TENSION ROD AND PISTON ROD

BACKGROUND OF THE INVENTION

1. Field of the Invention

The invention relates to a retainer for a printing plate on a plate-carrying cylinder of a rotary printing press. In particular, the invention relates to a device having a hook engageable in an elongated slot formed in the plate-carrying cylinder and terminating in an outer circumferential surface thereof, the hook being fixedly connected to a tension rod that is rotatably supported in a first elongated bore of the plate-carrying cylinder and rotatably guided about the longitudinal axis thereof by a drive mechanism so that it is alignable relative to two limiting directions corresponding to two limit positions of the hook, namely, a forward limit position for, respectively, hooking onto and unhooking from an edge of the printing plate in the elongated slot, and a rear limit position for bracing an edge of an end of the printing plate.

From the French Patent FR 2 709 090 that has the same corporate assignee as that of the instant application, such a device has become known heretofore wherein the drive mechanism includes a membrane that is inflatable with pressure medium.

However, a disadvantage of this system is that the membrane has a limited service life and a long response time for the supplying of the pressure medium.

Moreover, with the system described in the aforementioned French Patent FR 2 709 090, it is not possible to adjust the clamping of the top or leading edge of the printing plate by using the hook means, and to adjust the tension of this printing plate that is mounted on the plate-carrying cylinder.

Furthermore, in a different embodiment of the aforementioned French Patent FR 2 709 090, a system with wedges actuated by inflating a membrane is provided. This type of wedge system forming drive mechanisms for actuating the tension rod has a main disadvantage in that the wedges are displaceable in a support rod and, when a major deformation of this rod occurs, poor guidance of the wedges and poor functioning of the drive mechanism result. The support rod for the wedges has a large cross section. The number of wedges must be very high if they are to perform the mechanical action thereof.

It is accordingly an object of the invention to provide a retainer for a printing plate on a plate-carrying cylinder of a rotary printing press that overcomes the foregoing disadvantages heretofore known in the state of the art.

With the foregoing and other objects in view, there is provided, in accordance with the invention, a retainer for firmly holding a printing plate on a plate-carrying cylinder of a rotary printing press, having a hook engageable in an elongated slot formed in the plate-carrying cylinder and terminating in an outer circumferential surface thereof, the hook being fixedly connected to a tension rod that is rotatably supported in a first elongated bore of the plate-carrying cylinder, and a drive mechanism for rotatably guiding the tension rod about the longitudinal axis thereof so that it is alignable relative to two limiting directions corresponding to two limit positions of the hook, including a forward limit position for, respectively, hooking onto and unhooking from an edge of the printing plate in the elongated slot, and a rear limit position for bracing an edge of an end of the printing plate, comprising a piston rod forming part of the drive mechanism, the piston rod being supported in a second longitudinal bore formed in the plate-carrying cylinder, a lever system connecting the piston rod at both ends thereof to the tension rod, the piston rod carrying a plurality of pistons distributed over the length thereof, and a longitudinal conduit selectively suited for supplying pressure medium for positioning the pistons selectively in two extreme positions wherein, in an extended position of the pistons, the latter protrude from the outside of the piston rod so as to place the piston rod in a lower position corresponding to the front limit position of the hook and, in a retracted position of the pistons, the latter are retracted into the piston rod so as to place the piston rod in an upper position corresponding to the rear limit position of the hook.

In accordance with another feature of the invention, the pistons of the piston rod are always braced against a wall defining the second longitudinal bore of the plate-carrying cylinder.

In accordance with a further feature of the invention, the piston rod is mounted in connection levers for connecting the tension rod through an eccentric construction that permits positioning in accordance with a selected orientation of the connection levers with respect to a horizontal axis passing through the longitudinal axes of the piston rods and the tension rods, the orientation corresponding to a fixed orientation of the hook with respect to the horizontal axis.

In accordance with an added feature of the invention, the eccentric construction enables a positioning of the connection lever so that it forms an angle a of approximately 0±1° with the horizontal axis.

In accordance with an additional feature of the invention, each piston of the piston rod is positioned in a somewhat sleeve-shaped jacket and is releasably mounted in a bearing support of the piston rod.

In accordance with yet another feature of the invention, each piston of the piston rod includes a head formed with an inner chamber seated in a bearing support of the piston rod that communicates with a pressure medium supply conduit, the head being mounted with given play displaceably on a shaft in the bearing support of the piston rod, a restoring spring resting on the shaft and having one end that abuts a marginal ridge of the shaft, and another end abutting a component for mounting the head on the shaft, the piston being movable outwardly into a position wherein it protrudes from the piston rod and leads to a compression of the restoring spring, when an inflow of pressure medium into the inner chamber of the head takes place.

In accordance with yet a further feature of the invention, the shaft of each piston of the piston rod is pierced by a conduit terminating at one end in an upper portion of the inner chamber, and terminating at the other end thereof in the bearing support of the piston rod receiving the respective piston, so that at least some of the pressure medium that flows into the bearing support of the piston rod quickly moves upwardly through the conduit in the piston shaft into the upper portion of the inner chamber.

In accordance with yet an added feature of the invention, the elongated gap of the plate-carrying cylinder is defined at front and rear, respectively, with respect to the direction of rotation of the plate-carrying cylinder, by a front longitudinal side and a rear longitudinal side, each front and rear side being oriented, relative to the outer circumferential surface of the plate-carrying cylinder, so that, in the front portion of the connection thereof to the first longitudinal bore of the plate-carrying cylinder, the elongated gap adjoins the first longitudinal bore with respect to the direction of rotation of the cylinder, and the rear side, upon connection with the outer circumferential surface of the plate carrying cylinder, forms a wedge.

In accordance with yet an additional feature of the invention, the front longitudinal axis of the gap in the direction of rotation of the plate-carrying cylinder includes a forward-directed shoulder against which the hook is braced in a front limit position thereof and, in this position and in the rear limit position thereof, the hook remains inside the elongated gap of the plate-carrying cylinder, retreating from the outer circumferential surface of the plate-carrying cylinder.

In accordance with still another feature of the invention, the drive mechanisms include a torsion rod coaxial with the tension rod, the torsion rod being inclined towards the limit orientation thereof corresponding to the rear limit position of the hook, for resilient stressing of the torsion rod.

In accordance with a concomitant feature of the invention, for connecting the piston rod to the tension rod, upon a lowering movement of the piston rod into the second longitudinal bore of the plate-carrying cylinder, the connection lever includes a stop screw coming to a stop against a counterpart stop screw, the stop screw being built into the plate-carrying cylinder for limiting the lowering movement and thus the pivoting path of the connection levers.

Other especially advantageous features of the device according to the invention are as follows:

The pistons of the piston rod are always braced against the wall of the second longitudinal bore of the plate carrying cylinder.

The piston rod is mounted in connection levers through an eccentric construction, which enables the positioning in accordance with a selected orientation of the connection levers with respect to a horizontal axis that passes through the longitudinal axes of the piston and tension rods, this orientation corresponding to a fixed orientation of the hook means with respect to the horizontal axis.

As a result, this eccentric construction advantageously makes it possible to eliminate the clamping changes that have arisen from the interplay of geometric and dimensionally correct errors in the embodiment of the plate-carrying cylinder and the printing plate retainer, and assures optimal clamping of the head edge of the printing plate upon engagement with the longitudinal gap in the plate-carrying cylinder.

To this end, the eccentric construction makes it possible to position the connection levers so that it forms an angle with the horizontal axis of approximately 0±1°.

Furthermore, each piston of the piston rod is positioned according to the invention in a somewhat sleeve-shaped jacket and is releasably mounted in a receptacle of the piston rod.

The use of a detachable jacket is especially advantageous, because it makes it possible to compensate for the errors that occur in machining the piston bearings for receiving the pistons of the piston rod. This then makes it possible to reduce the production costs for such a piston rod to such an extent that the machining precision of these receptacles can be reduced.

Furthermore, these jackets make it possible to compensate for the possible play that occurs in the deformation of the piston rod when it is in motion.

Each piston of the piston rod of the retainer according to the invention includes a head with an inner chamber that terminates in a bearing of the piston rod communicating with the pressure medium supply conduit, the head being mounted with a given play displaceably on a shaft in the bearing of the piston rod, a restoring spring being disposed on the shaft and having one end thereof abutting a marginal ridge of the shaft and the other edge thereof abutting a component for the head on the shaft, so that the inflow of pressure medium into the inner chamber of the head of the piston causes the latter to move outwardly into a position wherein it protrudes from the piston rod, and leads to the compression of the restoring spring.

Advantageously, the shaft of each piston of the piston rod of the retainer according to the invention is pierced by a conduit which, at one end, terminates in the upper portion of the inner chamber of the head of the piston and, at the other end, terminates in the bearing support of the piston rod receiving the piston, so that at least some of the pressure medium that flows into the bearing support of the piston rod quickly moves upwardly through the conduit in the piston shaft into the upper portion of the inner chamber of the head of the piston.

Consequently, with the conduit of the piston shaft of each piston, it is possible to attain a maximum stroke of the piston heads immediately after putting the piston rod under pressure.

Each connection lever for connecting the piston rod to the tension rod includes a stop screw, that comes into contact with a counterpart stop screw, that is built into the plate-carrying cylinder, during the lowering movement of the piston rod into the second longitudinal bore of the plate-carrying cylinder, in order to limit this motion and thus the pivoting path of the connection levers.

Other features which are considered as characteristic for the invention are set forth in the appended claims.

Although the invention is illustrated and described herein as embodied in a retainer for a printing plate on a plate-carrying cylinder of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

Figure 1:
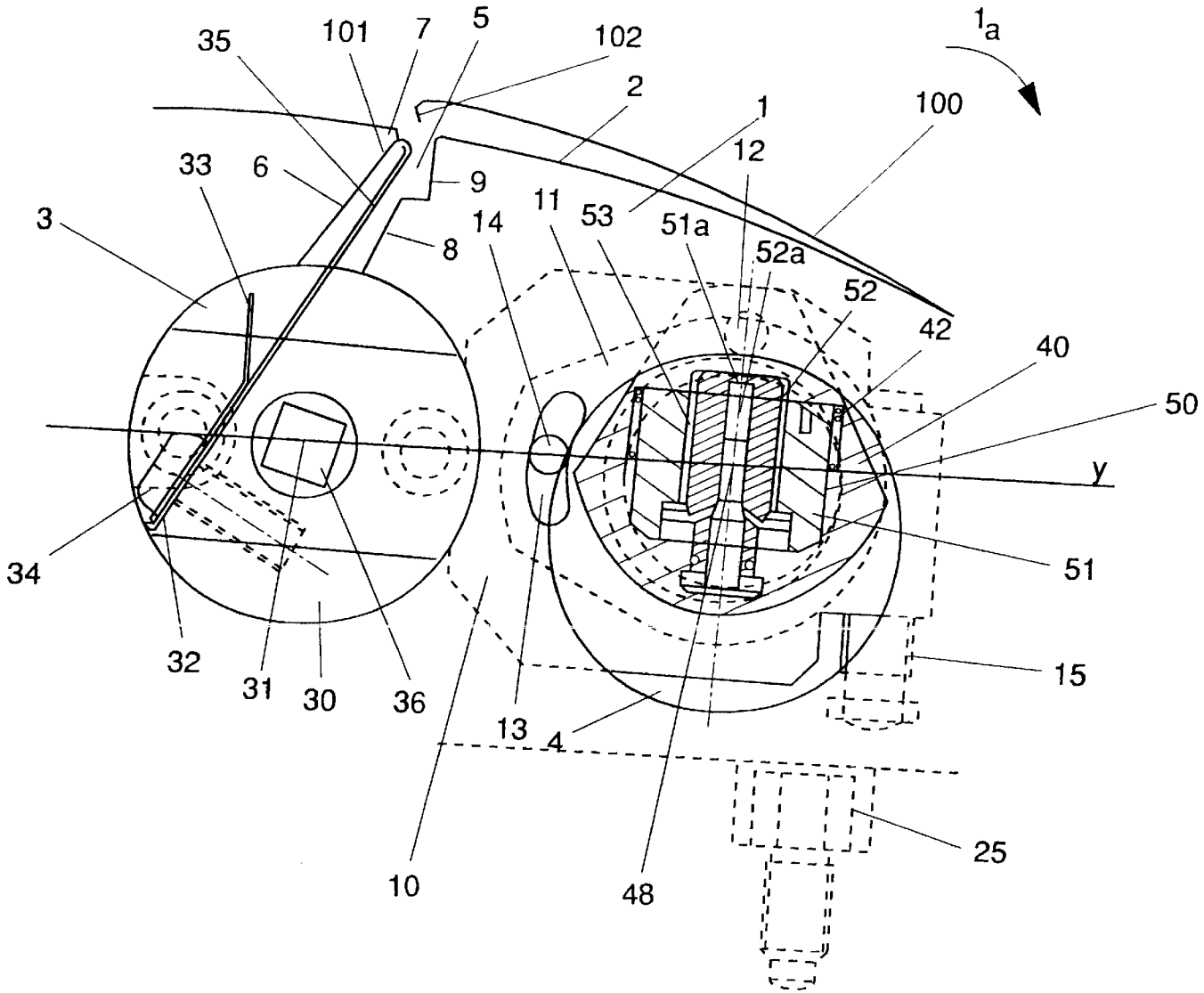
FIGS. 1 to 3 are fragmentary, diagrammatic cross-sectional views of a plate-carrying cylinder provided with a retainer according to the invention, illustrating three different stages in the mounting of a printing plate on the plate-carrying cylinder.
Figure 2:
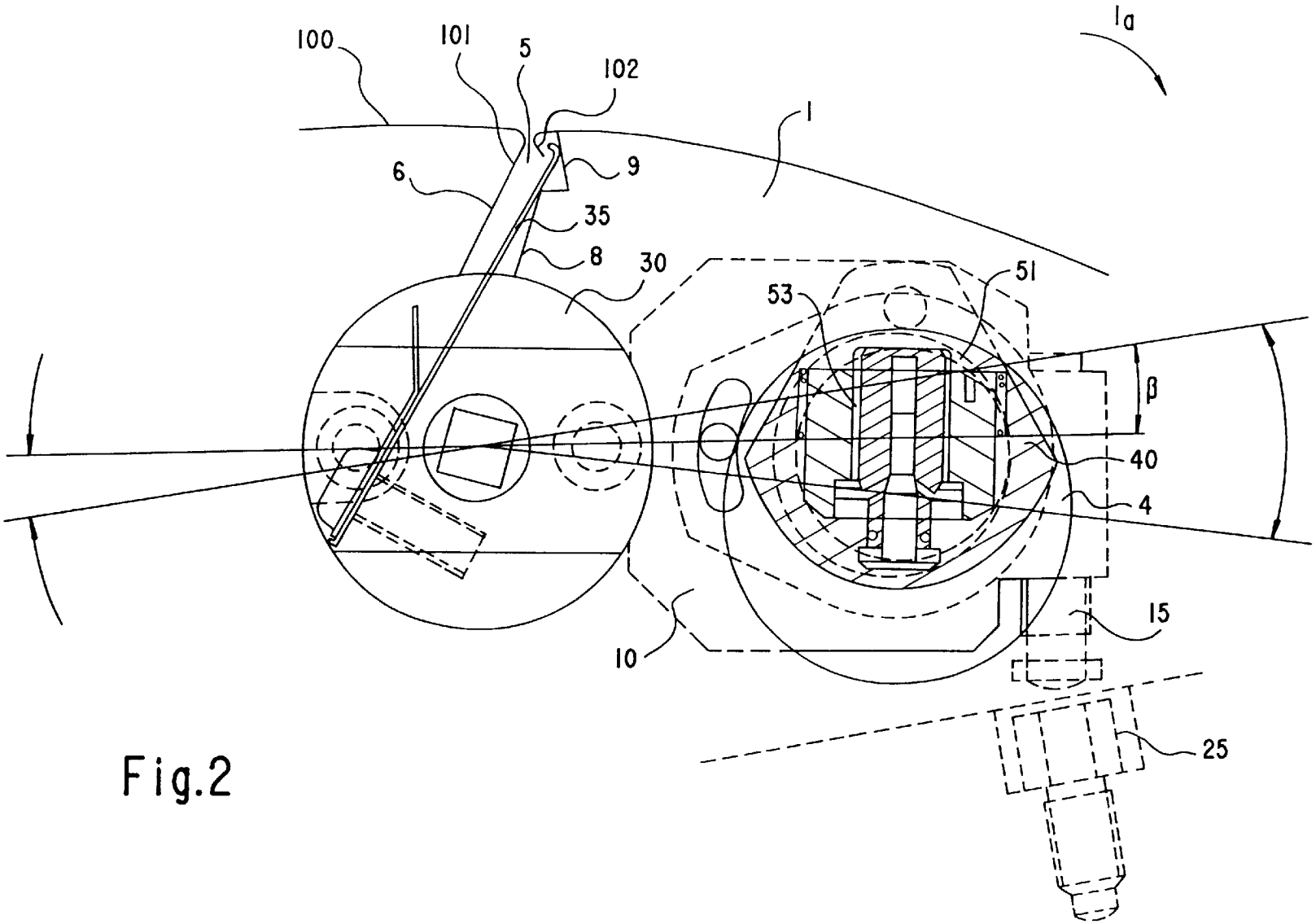
Figure 3:
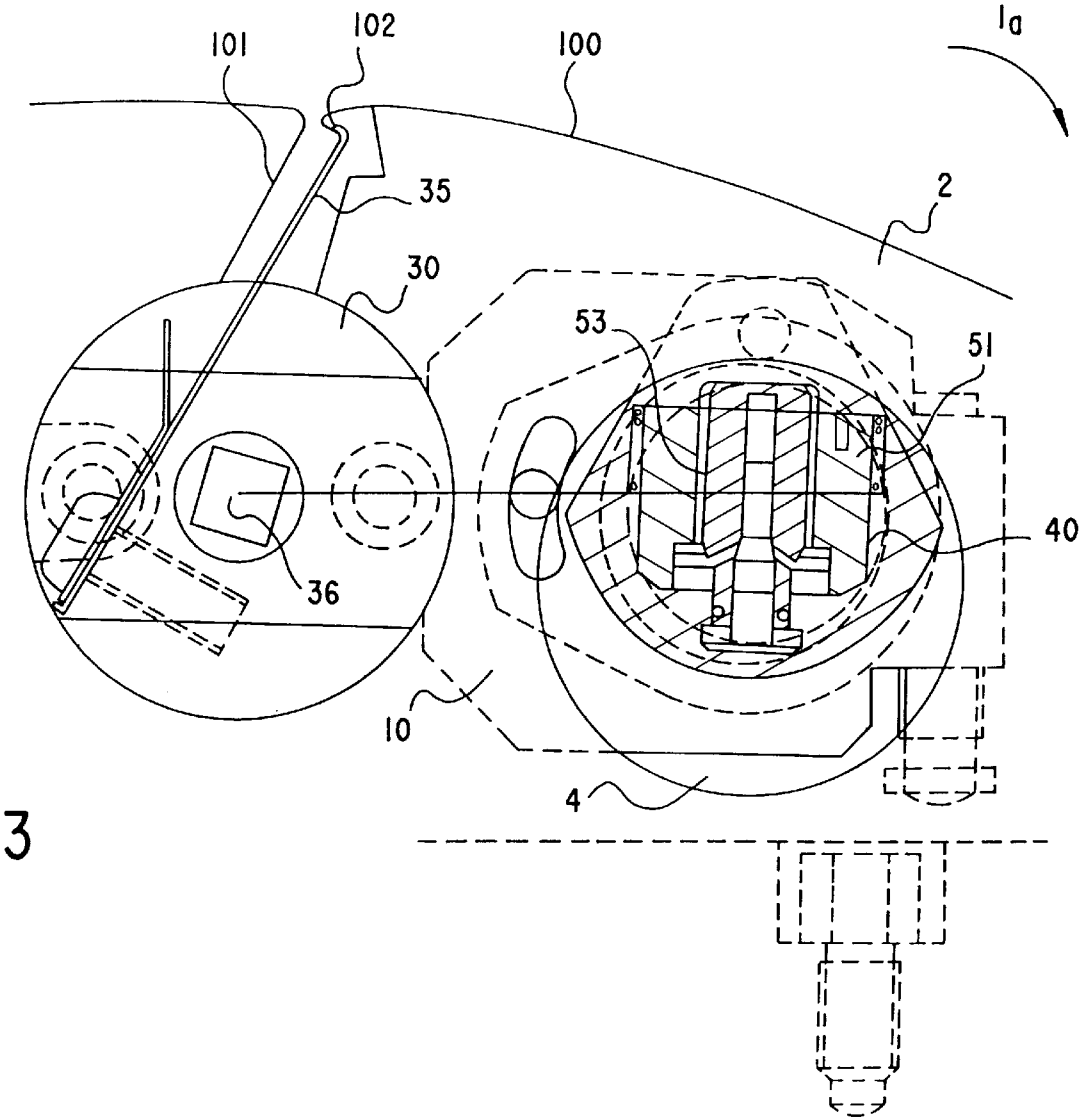

DESCRIPTION OF THE PREFERRED EMBODIMENTS:

Referring now to the drawings and, first, particularly to FIGS. 1 to 3 thereof, there is shown therein, in fragmentary form, a plate-carrying cylinder 1 of a rotary printing press including a retainer or a device for retaining a printing plate 100 on the cylinder 1.

FIGS. 1, 2 and 3 illustrate three different stages, described hereinafter in further detail, wherein the printing plate 100 is attached to the plate-carrying cylinder 1 with the aid of the aforementioned retainer device.

The plate-carrying cylinder 1 rotates about a non-illustrated pivot axis thereof, in a direction of rotation represented by an arrow 1*a*, which serves as a reference direction for understanding forward, rearward, leading and trailing movements.

The plate-carrying cylinder 1 includes, in a conventional manner, an elongated gap 5 terminating at one end thereof in the outer circumferential surface 2 of the plate-carrying cylinder 1, and at the other end thereof in a cylindrical longitudinal bore 3 that is formed in the immediate vicinity of the outer circumferential surface 2 of the plate-carrying cylinder 1.

The longitudinally-extending elongated gap 5 of the plate-carrying cylinder 1 is defined at the front and the rear, respectively, thereof, as viewed in the direction of rotation of the cylinder 1 represented by the arrow 1*a*, by a front longitudinal side 8 and a rear longitudinal side 6, respectively, and each front and rear side 8 and 6 is oriented, relative to the outer circumferential surface 2 of the plate carrying cylinder 1, in such a manner that, it connects thereto in the front portion of the connection thereof to the first longitudinal bore 3 of the plate-carrying cylinder 1.

The front and rear flanks 8 and 6, respectively, of the longitudinal gap 5 are substantially parallel to one another.

The rear flank 6 of the elongated gap, at the connection thereof with the outer circumferential surface 2 of the Plate-carrying cylinder 1, forms a wedge 7, onto which the hook-shaped head or leading edge 101 of the printing plate 100 is attached.

The retaining device for holding the printing plate 100 on the outer circumferential surface 2 of the plate-carrying cylinder 1 includes conventional hook-shaped members 35, which engage in the longitudinal gap 5 of the plate-carrying cylinder 1.

The hook-shaped members 35 are formed by suspension springs which are located adjacent one another or side by side in the longitudinal direction of the plate-carrying cylinder 1, only one of the suspension springs 35 being shown in any one of the figures of the drawings, and each thereof have a hook-shaped end located in the immediate vicinity of the outer circumferential surface 2 of the plate-carrying cylinder 1.

These suspension springs 35 are integral with a tension rod 30 supported in the first longitudinal bore 3 of the plate-carrying cylinder 1.

This elongated tension rod 30 is mounted and guided rotatably about the longitudinal axis 31 thereof in the first longitudinal bore 3 of the plate carrying cylinder. To that end, it is limited in an angular range of approximately 240° relative to the pivot axis 31 by a cylindrical outer circumferential surface extending all the way around this axis, the outer circumferential surface having a diameter that is substantially identical to that of the first longitudinal bore 3 of the plate-carrying cylinder, so that the outside thereof comes into sliding, rotating guidance contact with the wall of the first longitudinal bore 3 of the plate-carrying cylinder 1.

The tension rod 30 is additionally defined over an approximately 120° angle by an elongated flat face 32, on which the suspension springs 35 are mounted.

The mounting of the suspension springs 35, which are distributed regularly over the length of the tension rod 30, is effected by snapping it into place between the flat face 32 of the tension rod 30 and the guide springs 33 secured to the flat face 32 of the tension rod 30 by screws 34.

The tension rod 30 is guided pivotably about the longitudinal axis 31 thereof by drive mechanisms to be described hereinafter in greater detail, so that the tension rod can be oriented in accordance with two limit positions of the hook formed by the suspension springs 35, in relation to the direction of rotation 1*a* of the plate-carrying cylinder 1, namely a front limit position for attaching and disconnecting an edge of the printing plate 101 in the longitudinal gap 5 of the plate-carrying cylinder 1, and a rear limit position for placing the attached end or trailing edge 102 of the printing plate 100 under tension or for firmly clamping the head or leading edge 101 of the printing plate to the rear side 6 of the longitudinal gap 5.

Also, in a conventional manner, the aforementioned drive mechanisms include a torsion rod 36 having a square cross section for reception in a coaxial bearing of a longitudinal axis 31 of the tension rod 30. The torsion rod 36 is rotated at the ends thereof, at the non-illustrated transverse sides of the plate-carrying cylinder 1, via bearings, so that the torsion rod 36 urges the tension rod 30 elastically towards the limit orientation thereof, which is equivalent to the rear limit position of the suspension springs.

Furthermore, the drive mechanisms of the tension rod 30, according to the invention, have a piston rod 40 supported in a second longitudinal bore 4 of the plate-carrying cylinder 1.

This second longitudinal bore 4 of the plate-carrying cylinder 1 is located adjacent to the first longitudinal bore 3 and has a cylindrical shape, the axis of which is parallel to the axis of the first longitudinal bore 3 of the plate-carrying cylinder.

Figure 6:
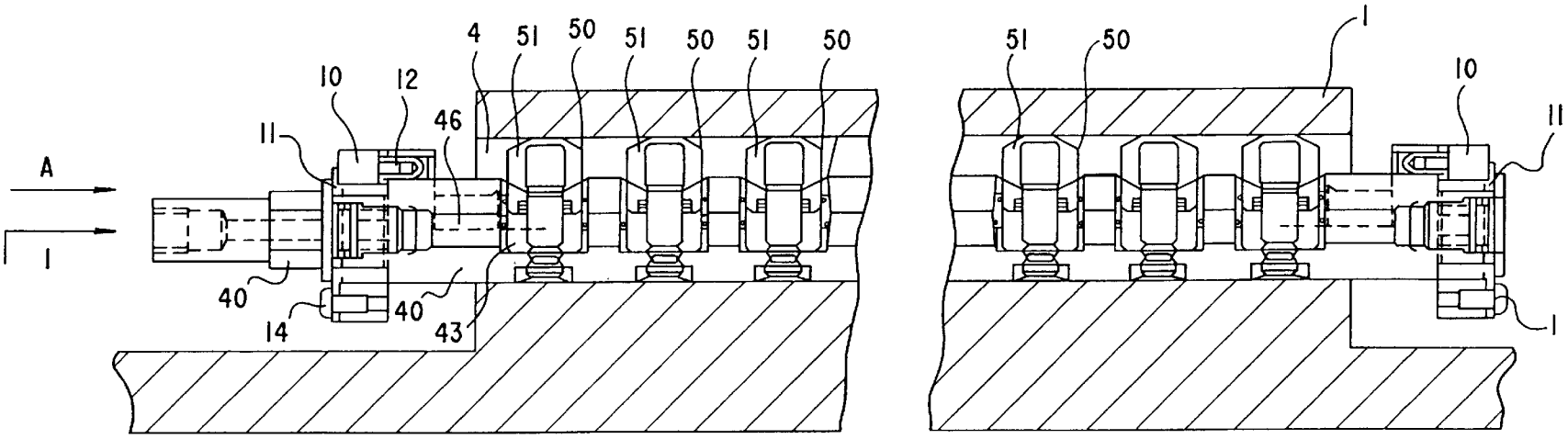
FIGS. 6 and 7 are longitudinal sectional views taken along the axis of the piston rod of the plate-carrying cylinder in two different positions of the retainer according to the invention, namely, an upper limit position and a lower limit position of the piston rod in the second longitudinal bearing of the plate-carrying cylinder.
Figure 7:
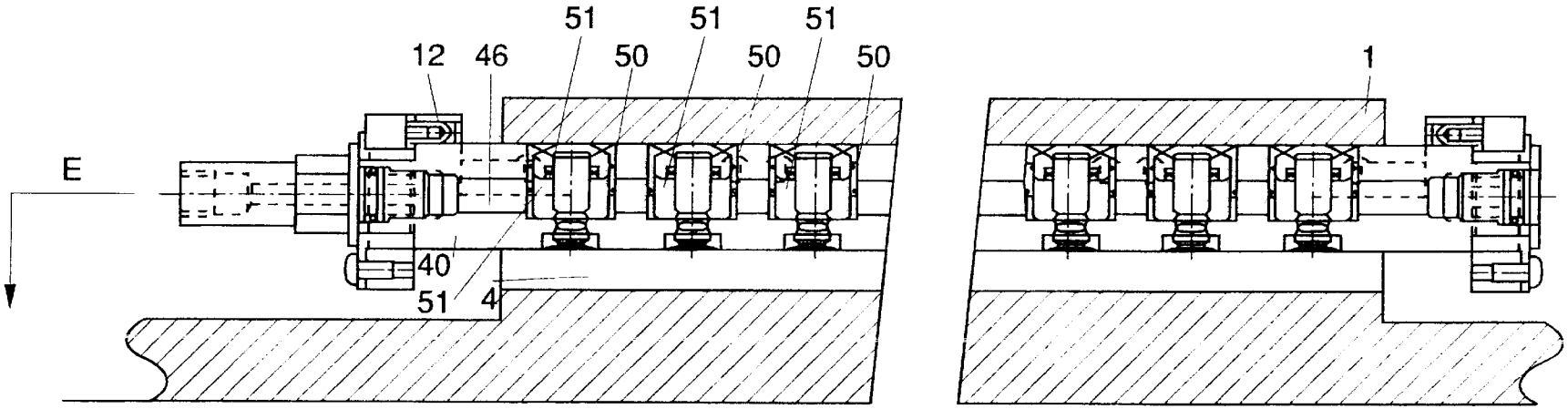

As is apparent from FIGS. 6 and 7, this piston rod 40 extends over the entire length of the plate-carrying cylinder 1 along the longitudinal axis of the second longitudinal bore 4 of this cylinder 1 and has a plurality of pistons 50 which, in the case at hand, are sixteen in number, and which are distributed over the total length of the piston rod 40.

Figure 4:
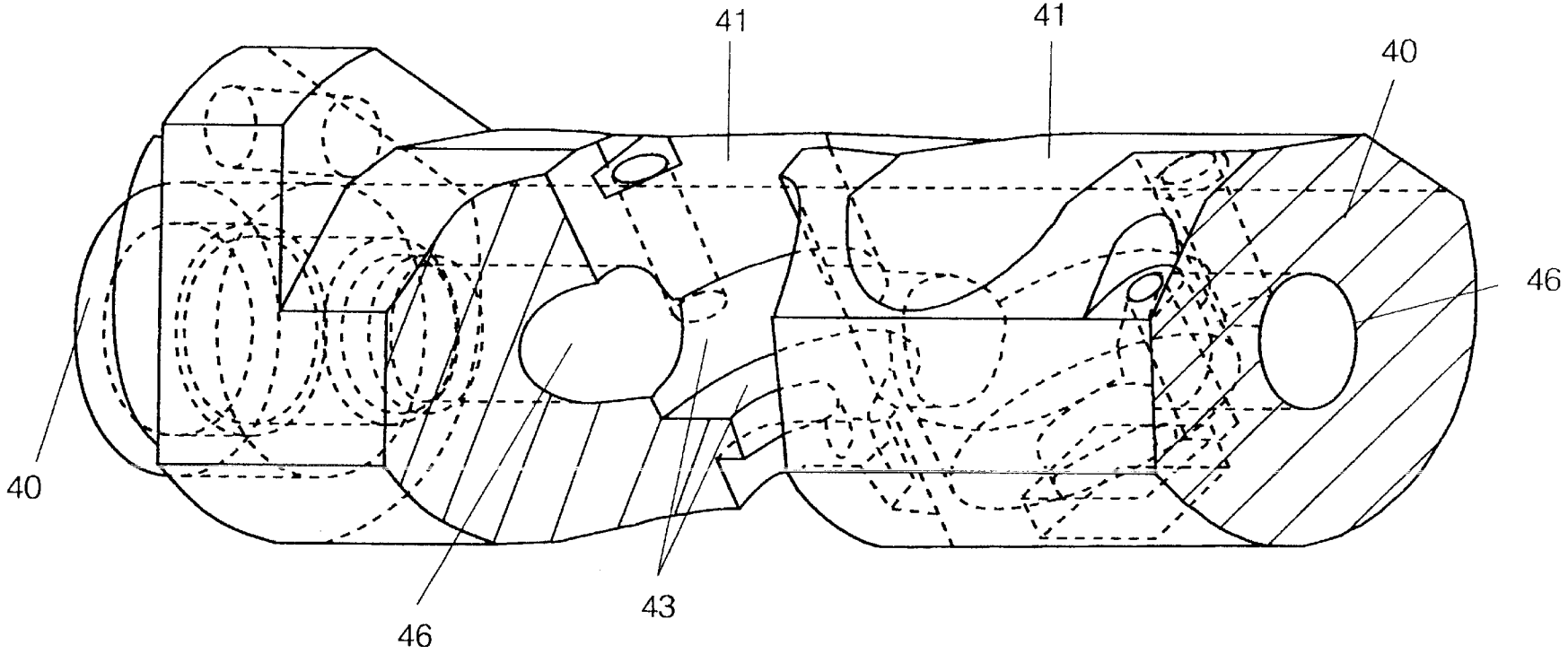
FIG. 4 is a fragmentary, diagrammatic perspective view of a piston rod of the retainer according to the invention, showing a detail in the vicinity of a bearing of a piston.
Figure 5:
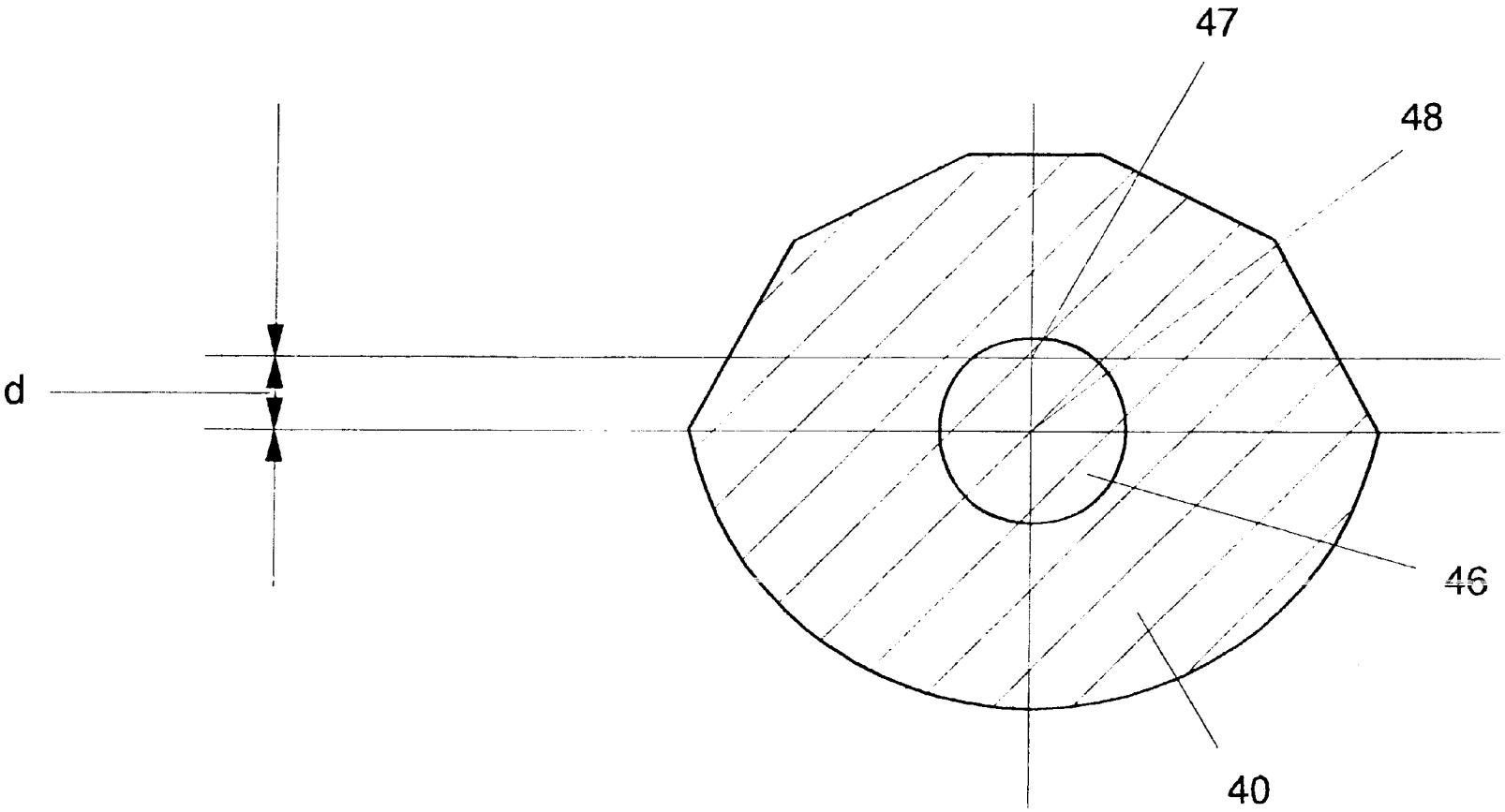
FIG. 5 is a forward or front view at a cross-sectional plane of the piston rod shown in FIG. 4, as seen from the righthand side of the latter figure.

As shown in FIGS. 4 and 5, this piston rod 40 has an overall cylindrical outer shape. In a lower part thereof, it is defined by a cylindrical face extending 1800 about the longitudinal axis 47 thereof, and in the upper part thereof, by a face with interrupted edges which also extend over approximately 180°.

The piston rod 40 has a number of bearing supports 41, which extend crosswise to the longitudinal axis 47 thereof and serve to receive the pistons 50.

The piston rod 40 also includes an elongated conduit 46, to which a pressure medium, in this case compressed air at $6\times10^5$ Pa, is supplied selectively via an end piece 40' (note FIG. 6), so as to position the pistons 50 selectively in two lower positions, namely an extended position projecting from the upper outside of this piston rod 40, wherein the pistons 50 push the piston rod 40 into a lower position (note FIG. 6) that corresponds to the front limit position of the suspension springs 35, and a position retracted into the piston rod 40 (see FIG. 7), in which the piston rod is moved into the upper position, which corresponds to the rear limit position of the suspension springs 35.

It should be noted that the pistons 50 of the piston rod 40, located in the second longitudinal bore 4 of the plate-carrying cylinder 1, are always braced against the wall of this bore 4.

For the upper and lower positioning of the piston rod in this bore 4 of the plate-carrying cylinder 1, it is also readily apparent that the cross section of the piston rod 40 is smaller than the cross section of the second longitudinal bore 4 of the plate-carrying cylinder 1.

The pressure-medium supply conduit 46 of the piston rod 40 has a cylindrical form surrounding an axis 48 and is offset by a spacing d of about 4 mm from the center 47 of the cylindrical surrounding casing of the piston rod 40.

This supply conduit 46 then terminates successively via bores 43 in the lower part of the bearing supports 41 of the piston rod 40 for receiving the pistons 50.

The piston rod 40 of the retainer device according to the invention is connected at both ends thereof to the tension rod 30 via a connection lever 10.

In particular, each of the ends of the piston rod 40 is mounted in a respective one of the connection levers 10 which are secured to the tension rod 30 by screws.

The installation of the piston rod 40 into the connection levers 10 is effected by eccentric components 11, which enable the positioning in accordance with a selected orientation of the connection levers 10 with respect to a horizontal axis Y that intersects the longitudinal axes 31 and 48 of the tension and piston rods 30 and 40, respectively, which is equivalent to a fixed orientation of the hook-shaped members, which in this case are suspension springs 35, relative to this horizontal axis Y.

Figure 9A:
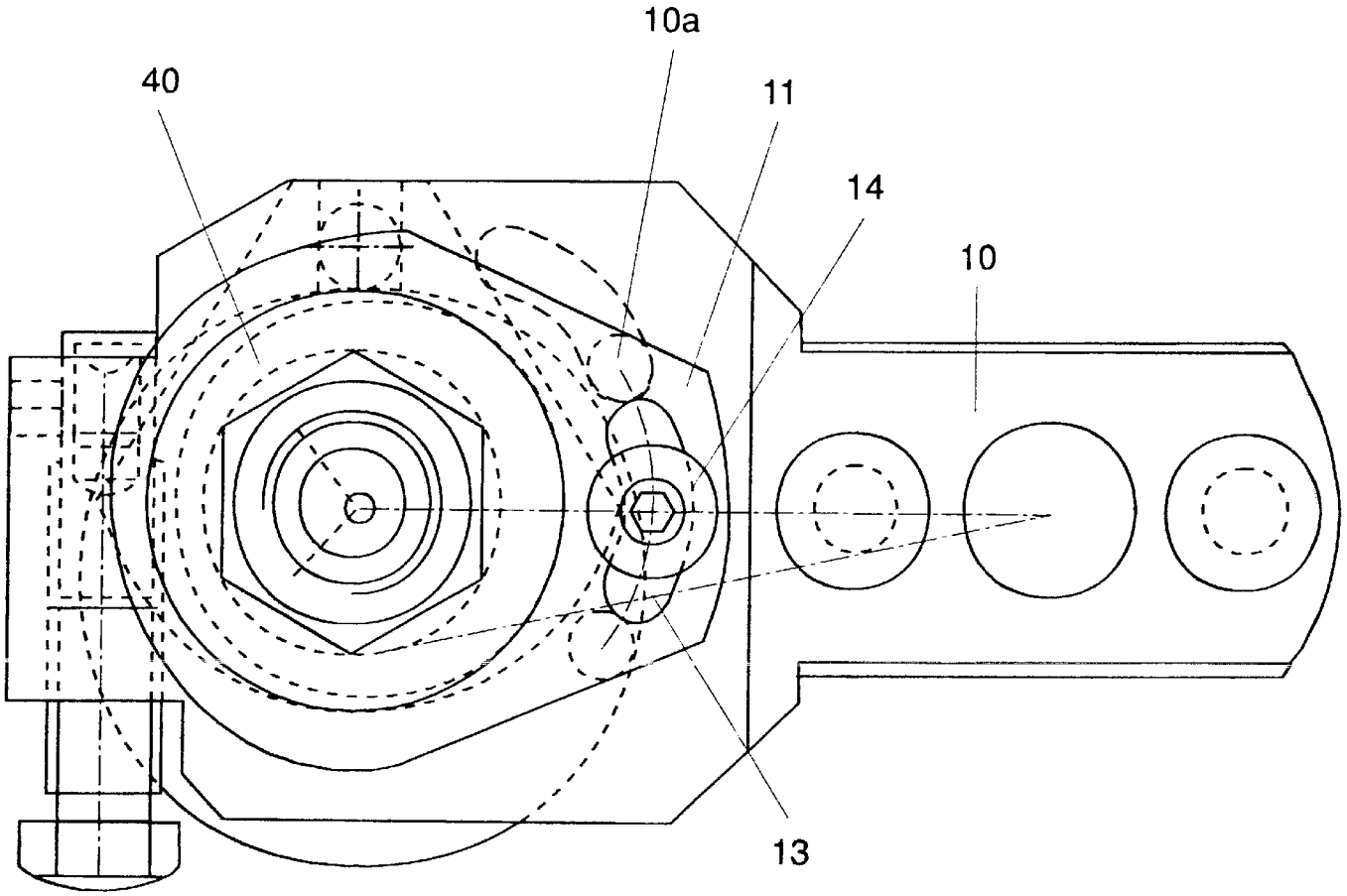
FIGS. 9*a*, 9*b* and 9*c* are three enlarged elevational views taken in the direction of the arrow A in FIG. 6 and showing the piston rod with an eccentric device disposed in three different positions.
Figure 9B:
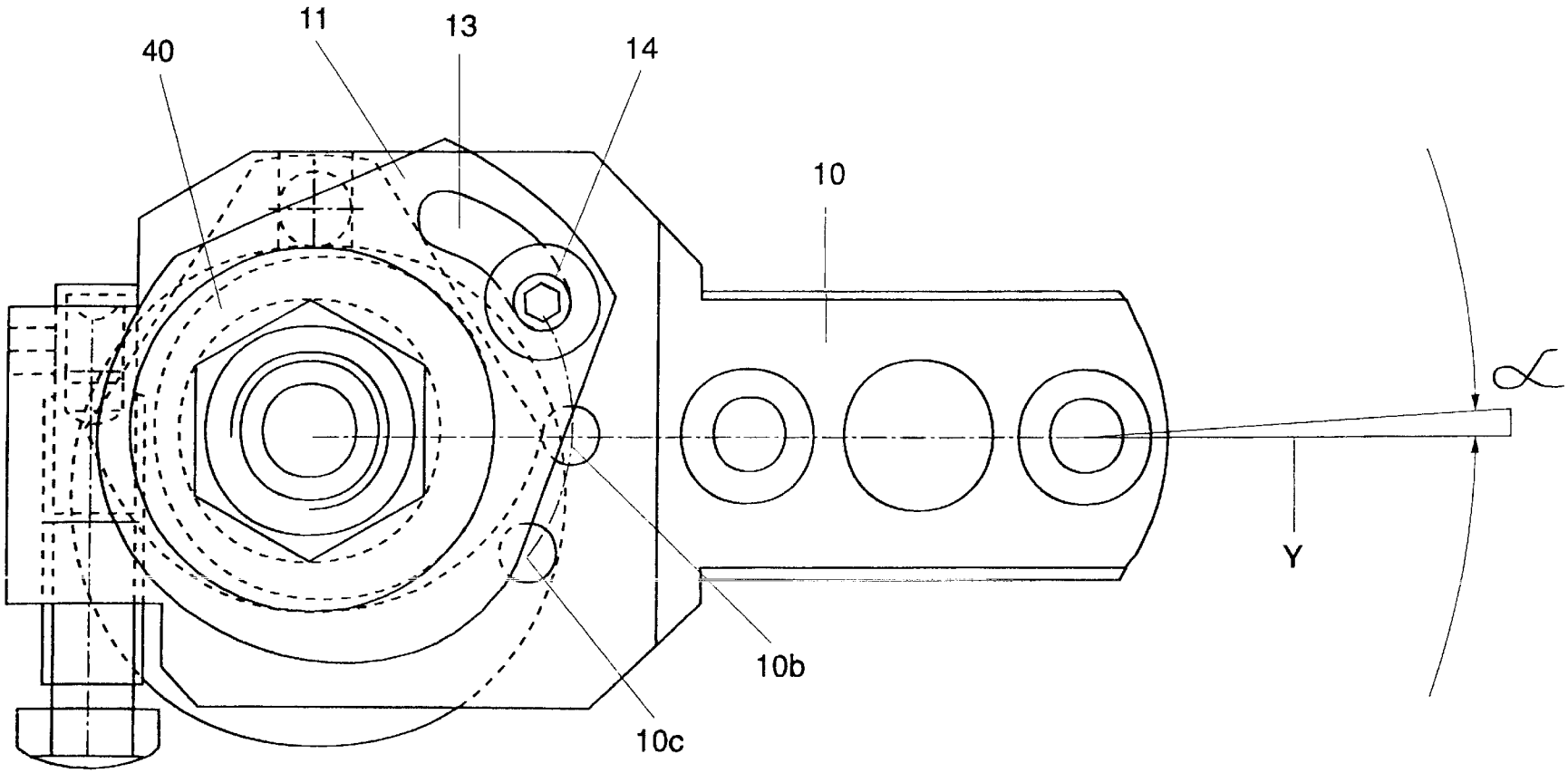
Figure 9C:
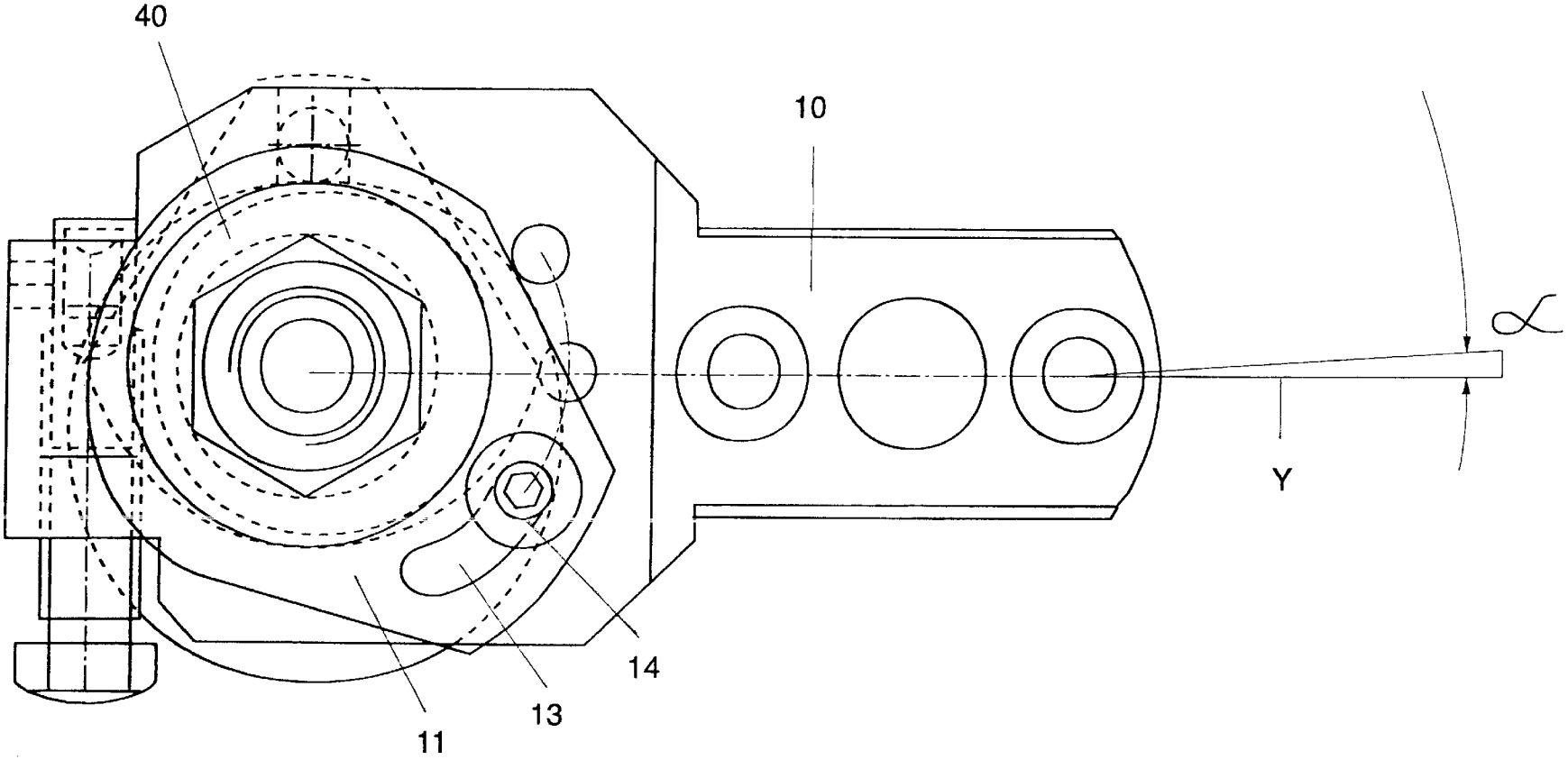

FIGS. 9*a*, 9*b*, and 9*c* are three enlarged elevation views in the direction of the arrow A shown in FIG. 6.

As shown extensively in FIGS. 9a to 9c, the installation of the ends of the piston rods 40 into each connection lever 10 is effected via an eccentric 11, that is insertable by a screw 14 that passes through an oblong slot 13 in one of the three openings 10*a*, 10*b* and 10*c*, respectively, which are provided in each connection lever 10 in accordance with three different angular positions.

FIG. 9*a* shows the installation of the eccentric 11 on each connection lever 10 in a middle position, wherein the screw 14 is screwed into an opening 10*b* located on the horizontal axis Y. In this position, the connection levers 10 are aligned with the axis Y, and the suspension springs 35 exert a medium clamping force on the cap screw of the printing plate.

In FIG. 9*b*, the eccentric 11 is mounted on each connection lever 10 in the upper position, wherein the retaining screw 14 of the eccentric 11 is screwed into the opening 10*a* located above the horizontal axis Y, in such a way that the piston rod 40 pulls each connection lever 10 slightly upwardly in order to position it at an angle of approximately 1° relative to the axis Y and to permit offsetting of the suspension springs 35 rearwardly relative to the direction of rotation 1*a* of the plate-carrying cylinder 1.

In this position, the suspension springs 35 exert a somewhat greater clamping force than is exerted thereby when they are oriented in a middle position, which corresponds to the position of the eccentric 11 shown in FIG. 9*a*.

In FIG. 9*c*, the eccentrics 11 are mounted in the lower position for attaching the ends of the piston rod 40 to the connection levers 10, each screw 14 being introduced into the opening 10*c* located below the horizontal axis Y, in such a manner, that the piston rod 40 pulls the connection levers 10 slightly rearwardly, so as to position them at an angle $\alpha$ of approximately 1° relative to the axis Y and thus to shift the suspension springs 35 forward.

In this position, the clamping force of the suspension springs 35 on the head or leading edge of the printing plate when the printing plate is being attached to the plate-carrying cylinder 1 is slightly reduced compared with the middle position.

To this extent, the eccentrics 11 advantageously permit compensating for the changes in clamping force that arise from the addition of the geometric and dimensionally-correct errors of the plate-carrying cylinder or printing plate, and they assure good adjustment of the clamping of the head or leading edge 101 of the printing plate by the suspension springs 35. The available amount of correction is 1°, as already described hereinbefore.

The fixing of the position of the piston rod 40 in the connection levers 10 is also effected by pins 12, which assure the angular positioning of the piston rod 40 with respect to the connection levers 10 in the adjustment of the eccentrics 11.

The connection levers 10, respectively, also have one stop edge 15, which comes to a stop against a counterpart stop screw 25 in the plate-carrying cylinder 1, in order to limit the angular deflection of the connection levers 10 to an angle of approximately 6°, the maximum allowable angle opening being approximately 13°.

Figure 8:
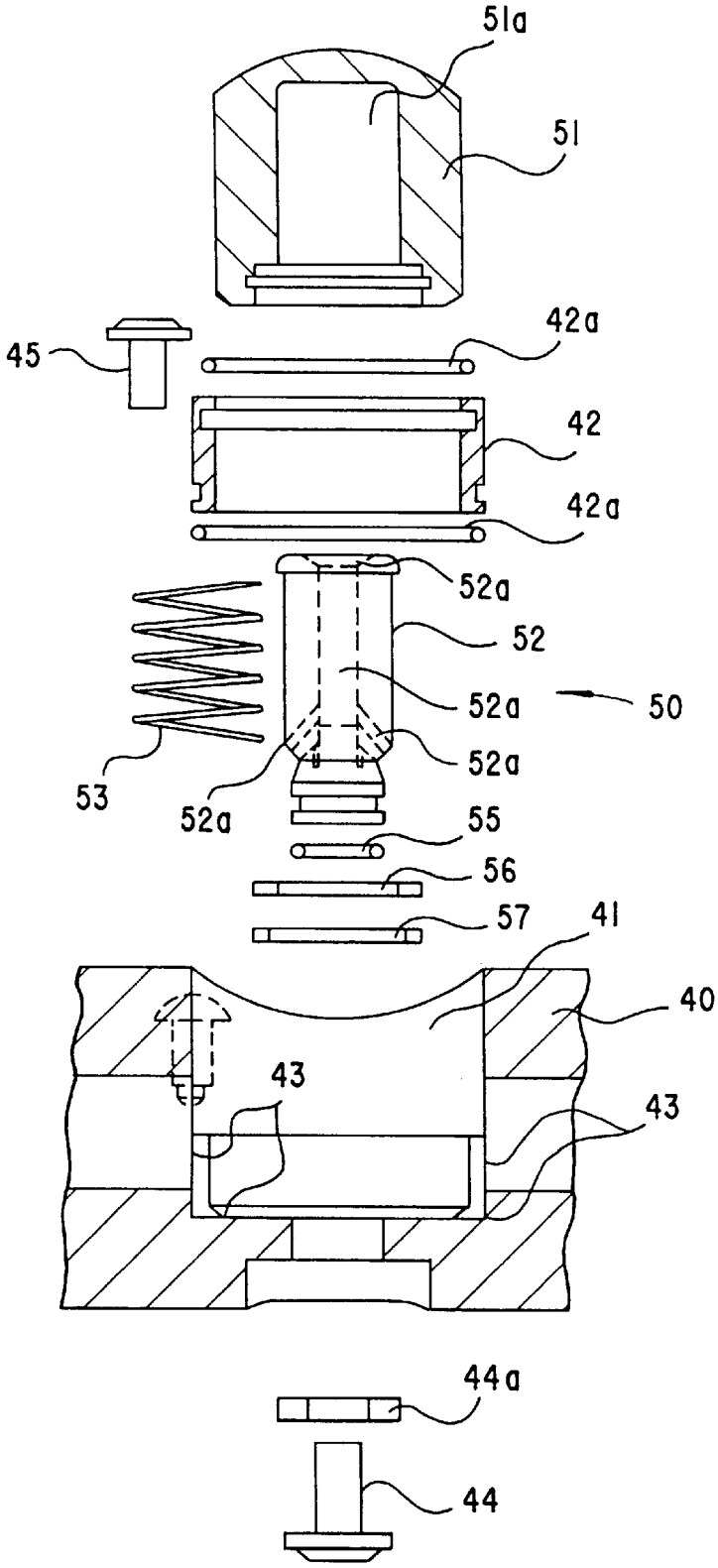
FIG. 8 is an exploded vertical sectional view of a piston of the piston rod of the retainer according to the invention.

With respect to FIG. 8, each piston 50 of the piston rod 40 is disposed in a jacket 42, that is installed essentially in a Sleeve-shaped manner and is releasable or detachable in a bearing support 41 of the piston rod 40.

This jacket 42 makes it possible advantageously to compensate for machining deviations and to make repair of the piston rod 40 easier.

Two O-ring seals 42*a*, respectively, disposed on each side of each jacket, assure the tightness of this region at the respective ends.

The jackets 42 are fixed in the bearing supports 41 of the piston rod 40 by a screw 45, that is introduced into an opening (note FIG. 4) provided for that purpose in the piston rod 40.

Each piston 50 has a head 51, with an inner chamber 51*a* that terminates at one end thereof in the bearing support 41 corresponding to the piston rod 40, the bearing support 41 communicating through the bores 43 with the pressure-medium supply conduit 46.

The head 51 of each piston 50 is disposed displaceably, with a given amount of play, on a shaft 52 secured in the bearing support 41 of the piston rod 40, via the screw 44 screwed into a lower opening of the piston rod 40.

A washer 44*a* secured against relative rotation is installed between the screw 44 and the installation opening of the shaft 52 in the bearing support 41 of the piston rod 40. A seal 55 assures tightness in the region of the screw 44.

A shim 56 and a securing bracket 57 are also provided for assembling the head 51 on the shaft 52 that is mounted in the bearing 41 corresponding to the piston rod 40.

A restoring spring 53 is disposed around the shaft 52, one end of the spring 53 coming to a stop against an edge located above the shaft 52, and the other end of the spring 53 resting against a component of the head 51 on the shaft 52, in this case the component being the shim 56 and the securing bracket 57.

When pressure medium is supplied through the supply conduit 46, as indicated by the arrow I in FIG. 6, into the bores 43, which terminate in the bearing support 41 where a piston is located, the rise of the pressure medium into the inner chamber 51*a* of the head leads to the upward movement of the head of the piston rod 40 that protrudes from the upper outer face and to the compression of the spring wound onto the shaft 52, between the two stop edges.

When the pressure medium supply into the supply conduit 46 is turned off, the restoring spring assumes the relieved starting position thereof and returns the piston head 51 back into the interior of the bearing support 41 of the piston rod 40.

To attain a maximum stroke of each head 51 of each piston in the shaft 52 of each piston during the process of supplying pressure medium, an axial conduit 52*a* is advantageously provided, that terminates at one end 52*a*''' thereof in the upper part of the inner chamber 51*a* of the piston head 51 and, at the lower part, through two branch lines 52*a*' and 52*a*", terminates in the lower part of the bearing support 41 of the piston rod 40.

This conduit 52*a* of the shaft 52 of the piston 50 allows the pressure medium to rise rapidly into the upper part of the inner chamber 51*a* of each head 51 of each piston, so that the rise of the medium to the head of the piston is greatest when the piston rod 40 is put under negative or reduced pressure.

The mode of operation of the printing-plate retainer described hereinabove will now be described and, in particular, the attachment of a printing plate to an outer plate of a plate-carrying cylinder with the aid of such a retainer will be described.

When an operator wants to place a printing plate 100 on the outer circumferential surface of a plate-carrying cylinder 1, he or she first introduces pressure medium, in this case compressed air at a pressure of $6\times10^5$ Pa, through the mouthpiece 40'in the direction of the arrow I (note FIG. 6), into the piston rod 40, so that the pistons 50 of this piston rod 40 assume the extended position thereof (note FIG. 6), in order to move the piston rod 40 into the lower position into the second elongated bore 4 of the plate-carrying cylinder 1 and to tilt the connection levers 10 in such a way that the suspension springs 35 are pivoted away, by pivoting of the tension rod into the front limit position against the front edge of the longitudinal gap 5 of the plate-carrying cylinder 1.

In this regard, it should be noted that, according to the invention, the front side 8 of the longitudinal gap 5 of the plate-carrying cylinder 1 advantageously has a shoulder 9 that protrudes forward in the direction of rotation represented by the arrow la of the plate-carrying cylinder 1, the suspension springs 35, as they open, engaging in the shoulder 9.

Here, the hooks of the suspension springs 35 always remain recessed in the interior of the gap from the outer circumferential surface of the plate-carrying cylinder 1, specifically both in the front and the lower limit position.

The opening of the hooks of the suspension springs 35 corresponds to a tilting motion of the respective spring in the direction of rotation represented by the arrow 1*a* of the plate carrying cylinder 1.

In the front limit position, the tension rod, pivoted into the bore 3 thereof, exerts an additional torque on the rotated ends of the torsion rod 36.

In this position, the operator introduces the bent-back head edge 101 of the printing plate 100 into the longitudinal gap 5, at the wedge 7 formed by the connection of the rear side 6 of the gap with the outer circumferential surface of the plate-carrying cylinder 1.

Then, the operator turns off the supply of pressure medium through the mouthpiece 40'of the piston rod 40 and sets the supply circuit to evacuation, in accordance with the arrow E shown in FIG. 7.

This evacuation leads to the retraction of the pistons 50 into the piston rod 40, and the torsion rod 36 then urges the tension rod resiliently to pivot in the direction of the limit orientation thereof corresponding to the positioning of the suspension springs 35 in the rear limit position thereof, the consequence of which is a renewed rise of the piston rod to the upper starting position thereof, as shown in FIG. 1, and the clamping of the lead edge 101 in place by the hooks of the suspension springs 35 (note FIG. 1).

As explained hereinbefore, the clamping force at the start of the installation of the retainer into the plate-carrying cylinder can be adjusted with the aid of the eccentrics 11.

Finally, the operator sets the plate-carrying cylinder 1 into rotation in the direction of rotation represented by the arrow 1*a* so that the printing plate 100 wraps around the plate-carrying cylinder 1.

The operator then reintroduces the pressure medium back into the supply conduit of the piston rod 40 in order to cause the piston rod to move outwardly and to position the piston rod in the lower position in the longitudinal bore 4 of the plate-carrying cylinder 1, which leads to a tilting away of the connection levers at an angle $\alpha$of approximately 6° (note FIG. 2) and to the swiveling away of the tension rod.

In this position, the suspension springs 35 are tipped back into the front limit position, so that the hooks thereof come to rest against the shoulder 9 of the front flank 8 of the longitudinal gap 5 of the plate-carrying cylinder 1. This tilting of the suspension springs 35 is effected by the tension rod 30, that is entrained rotationally in the bore thereof by the pivotable connection levers 6. This tension rod rotates at approximately 6° of amplitude in the direction of rotation represented by the arrow 1*a* of the plate-carrying cylinder 1.

The printing plate 100 ends the roll-up thereof on the plate-carrying cylinder 1, and the end edge 102 of the plate is then naturally located in front of the hook-shaped end of the suspension springs 35 disposed in the aforementioned position (note FIG. 2).

The operator then terminates the supply of pressure medium to the piston rod 40.

This causes the pistons to retract into the piston rod 40 and causes the tension rod 30 to return to the rear limit position under the influence of the torsion rod 36.

The connection levers tilt back, and the suspension springs assume the rear limit position thereof, as shown in FIG. 3, in the tension position of the end edge 102 of the printing plate 100 placed on the plate-carrying cylinder 1. In this position, the piston rod 40 is again in the upper position thereof in the bore 4 of the plate-carrying cylinder 1.

As noted hereinbefore, the invention of the instant application is in no way limited to the embodiments shown and described; a person or persons skilled in the art can make any appropriate change therein.

I claim:

1. An apparatus for firmly holding a printing plate having a leading edge and a trailing edge, the apparatus comprising:

a plate-carrying cylinder having an outer circumferential surface and formed with a first elongated bore extending along a longitudinal axis and a second elongated bore, said plate-carrying cylinder formed with an elongated gap terminating at the outer circumferential surface;

a hook engageable in the elongated gap of said plate-carrying cylinder;

a tension rod fixedly connected to said hook and rotatable supported about the longitudinal axis in the first elongated bore, said tension rod being rotatable to a forward limit position for selectively hooking onto and unhooking from the leading edge of the printing plate, said tension rod being rotatable to a rear limit position for bracing an edge selected from the leading edge of the printing plate and the trailing edge of the printing plate;

a drive mechanism for rotatably guiding said tension rod to said forward limit position and to said rear limit position, said drive mechanism including a piston rod supported in the second longitudinal bore, said piston rod having ends and a length and carrying a plurality of pistons distributed over said length, each one of said plurality of pistons being moveable to an extended position to place said piston rod in a lower position in which said tension rod is rotatably guided to said forward limit position, each one of said plurality of pistons being moveable to a retracted position to place said piston rod in an upper position in which said tension rod is rotatably guided to said rear limit position;

a lever system connecting said ends of said piston rod to said tension rod; and a longitudinal conduit for supplying a pressured medium for positioning each one of said plurality of pistons in said extended position and in said retracted position.

2. The apparatus according to claim 1, wherein said pistons of said piston rod are always braced against a wall defining the second longitudinal bore of the plate-carrying cylinder.

3. The apparatus according to claim 1, including connection levers, said piston rod mounted in said connection levers for connecting said tension rod through an eccentric construction that permits positioning in accordance with a selected orientation of said connection levers with respect to a horizontal axis passing through the longitudinal axes of said piston rods and said tension rod, the orientation corresponding to a fixed orientation of said hook with respect to said horizontal axis.

4. The apparatus according to claim 3, wherein said eccentric construction enables a positioning of said connection levers so that they form an angle $\alpha$ of approximately $0\pm1°$ with the horizontal axis.

5. The apparatus assembly according to claim 3, wherein, for connecting said piston rod to said tension rod, upon a lowering movement of said piston rod into the second longitudinal bore of said plate-carrying cylinder, said connection levers include a stop edge coming to a stop against a counterpart stop screw, said stop screw being built into said plate-carrying cylinder for limiting the lowering movement and thus the pivoting path of said connection levers.

6. The assembly apparatus according to claim 1, including a plurality of jackets, said piston rod including a plurality of bearing supports, said plurality of bearing supports being fixed to said plurality of jackets, each one of said plurality of pistons being positioned in one of said plurality of jackets and being releasably mounted in one of said plurality of bearing supports.

7. The apparatus according to claim 1, wherein each piston of said piston rod includes a head formed with an inner chamber seated in a bearing support of said piston rod that communicates with a pressure medium supply conduit, said head being mounted with given play displaceably on a shaft in said bearing support of said piston rod, a restoring spring resting on said shaft and having one end that abuts a marginal ridge of said shaft, and another end abutting a component for mounting said head on said shaft, said piston being movable outwardly into a position wherein it protrudes from said piston rod and leads to a compression of said restoring spring, when an inflow of pressure medium into said inner chamber of said head takes place.

8. The apparatus according to claim 7, wherein the shaft of each piston of said piston rod is pierced by a conduit terminating at one end in an upper portion of said inner chamber, and terminating at the other end thereof in said bearing support of said piston rod receiving the respective piston, so that at least some of the pressure medium that flows into said bearing support of said piston rod quickly moves upwardly through said conduit in said piston shaft into said upper portion of said inner chamber.

9. The apparatus according to claim 1, wherein the elongated gap of the plate-carrying cylinder is defined at front and rear, respectively, with respect to the direction of rotation of the plate-carrying cylinder, by a front longitudinal side and a rear longitudinal side, each front and rear side being oriented, relative to the outer circumferential surface of the plate-carrying cylinder, so that, in the front portion of the connection thereof to the first longitudinal bore of the plate-carrying cylinder, the elongated gap adjoins the first longitudinal bore with respect to the direction of rotation of the cylinder, and the rear side, upon connection with the outer circumferential surface of the plate carrying cylinder, forms a wedge.

10. The apparatus assembly according to claim 9, wherein said front longitudinal side of said gap in the direction of rotation of the plate-carrying cylinder includes a forward-directed shoulder against which the hook is braced in a front limit position thereof and, in this position and in the rear limit position thereof, the hook remains inside said elongated gap of the plate-carrying cylinder, retreating from the outer circumferential surface of the plate-carrying cylinder.

11. The apparatus according to claim 1, wherein said drive mechanism includes a torsion rod coaxial with said tension rod, said torsion rod being inclined towards the limit orientation thereof corresponding to the rear limit position for resilient stressing of said torsion rod.

* * * * *